US010714865B2

(12) United States Patent
Liu et al.

(10) Patent No.: US 10,714,865 B2
(45) Date of Patent: Jul. 14, 2020

(54) CONNECTOR HOUSING WITH A CONNECTING MECHANISM TO PREVENT ELECTROMAGNETIC LEAKAGE NEAR THE INSERTION PORT

(71) Applicant: Tyco Electronics (Shanghai) Co. Ltd., Shanghai (CN)

(72) Inventors: WenYu Liu, Shanghai (CN); Hongqiang Han, Shanghai (CN); Lizhou Li, Shanghai (CN); Youwei Pan, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/976,234

(22) Filed: May 10, 2018

(65) Prior Publication Data

US 2018/0331459 A1 Nov. 15, 2018

(30) Foreign Application Priority Data

May 10, 2017 (CN) ..... 2017 2 0516444 U

(51) Int. Cl.

| | |
|---|---|
| ***H01R 13/516*** | (2006.01) |
| ***H01R 12/71*** | (2011.01) |
| ***H01R 13/50*** | (2006.01) |
| ***H01R 13/502*** | (2006.01) |
| ***H01R 13/6583*** | (2011.01) |
| ***H01R 13/6594*** | (2011.01) |
| ***H01R 13/6596*** | (2011.01) |
| *H01R 13/6582* | (2011.01) |

(52) U.S. Cl.
CPC ..... *H01R 13/516* (2013.01); *H01R 12/712* (2013.01); *H01R 13/50* (2013.01); *H01R 13/502* (2013.01); *H01R 13/6583* (2013.01); *H01R 13/6594* (2013.01); *H01R 13/6596* (2013.01); *H01R 13/6582* (2013.01)

(58) Field of Classification Search
CPC .... H01R 13/516; H01R 12/712; H01R 13/50; H01R 13/502; H01R 13/6582
USPC ..... 439/345, 607.54, 607.55, 607.28
See application file for complete search history.

(56) References Cited

U.S. PATENT DOCUMENTS

| | | | | |
|---|---|---|---|---|
| 4,545,640 | A * | 10/1985 | Buchberger | H01R 4/36 439/811 |
| 6,478,622 | B1 * | 11/2002 | Hwang | H05K 9/0058 439/607.2 |
| 6,612,868 | B2 * | 9/2003 | Hwang | H05K 9/0058 439/607.54 |
| 7,727,018 | B2 * | 6/2010 | Bright | H01R 13/741 439/607.28 |
| 7,901,221 | B1 * | 3/2011 | Li | H01R 13/6582 439/95 |
| 8,011,969 | B2 * | 9/2011 | Wang | H01R 24/60 439/660 |

(Continued)

*Primary Examiner* — Travis S Chambers
(74) *Attorney, Agent, or Firm* — Barley Snyder

(57) ABSTRACT

A connector housing comprises a plurality of walls enclosing a receiving space and defining an insertion port. Each of a pair of adjacent walls of the plurality of walls has one of a pair of connecting mechanisms at adjacent edges of the pair of adjacent walls near the insertion port. The pair of connecting mechanisms are complementary to each other and the adjacent edges of the pair of adjacent walls are connected to each other by the connecting mechanisms.

8 Claims, 6 Drawing Sheets

(56) References Cited

U.S. PATENT DOCUMENTS

| | | | | |
|---|---|---|---|---|
| 9,590,362 | B2 * | 3/2017 | Wan | H01R 13/6583 |
| 9,692,145 | B2 * | 6/2017 | Seehoffer | H01R 4/30 |
| 2015/0200495 | A1 * | 7/2015 | Yu | H01R 13/6583<br>439/607.55 |

* cited by examiner

CONNECTOR HOUSING WITH A CONNECTING MECHANISM TO PREVENT ELECTROMAGNETIC LEAKAGE NEAR THE INSERTION PORT

CROSS-REFERENCE TO RELATED APPLICATIONS

This application claims the benefit of the filing date under 35 U.S.C. § 119(a)-(d) of Chinese Patent Application No. 201720516444.X, filed on May 10, 2017.

FIELD OF THE INVENTION

The present invention relates to an electrical connector and, more particularly, to a connector housing for an electrical connector.

BACKGROUND

Electrical connectors have increasingly high transmission rates. For a high-speed connector, in order to ensure that a transmitted signal is free from external electromagnetic interference, the high-speed connector requires a connector housing assembled with a metal sheet.

In the known connector housing, two adjacent walls are not tightly connected at a corner where adjacent edges of the adjacent walls meet, and a gap is formed between the two adjacent edges. When a plug is inserted into the connector, the two adjacent walls of the connector housing of the connector are outwardly stretched, enlarging the gap between adjacent edges of the two adjacent walls. Significant electromagnetic leakage occurs through the large gap at the corner of the connector housing, reducing the electromagnetic shielding effect and signal transmission quality of the connector.

SUMMARY

A connector housing comprises a plurality of walls enclosing a receiving space and defining an insertion port. Each of a pair of adjacent walls of the plurality of walls has one of a pair of connecting mechanisms at adjacent edges of the pair of adjacent walls near the insertion port. The pair of connecting mechanisms are complementary to each other and the adjacent edges of the pair of adjacent walls are connected to each other by the connecting mechanisms.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
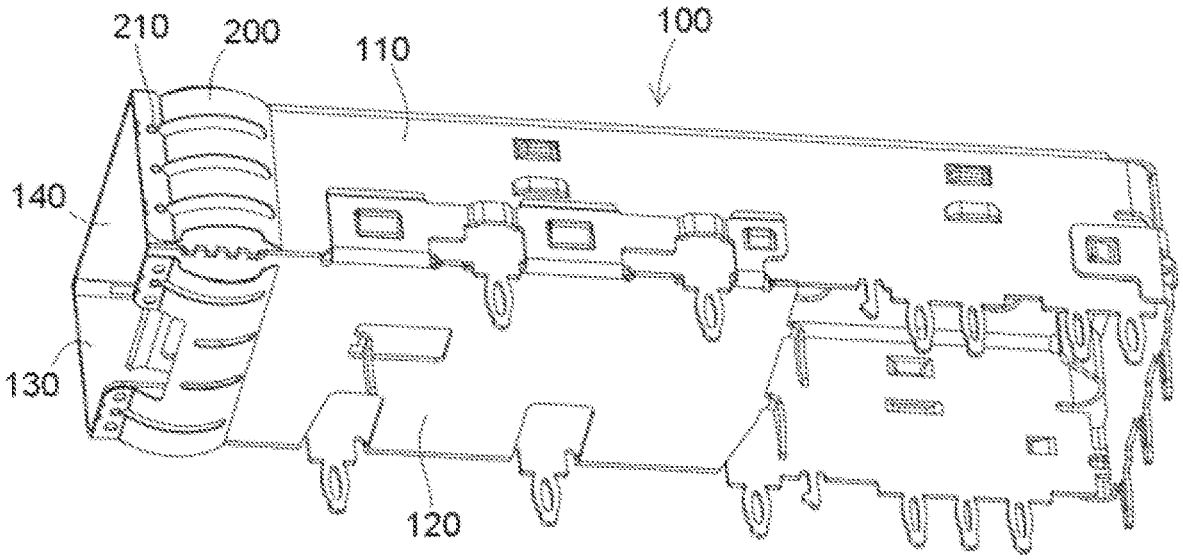
FIG. 1 is a perspective view of a connector housing according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
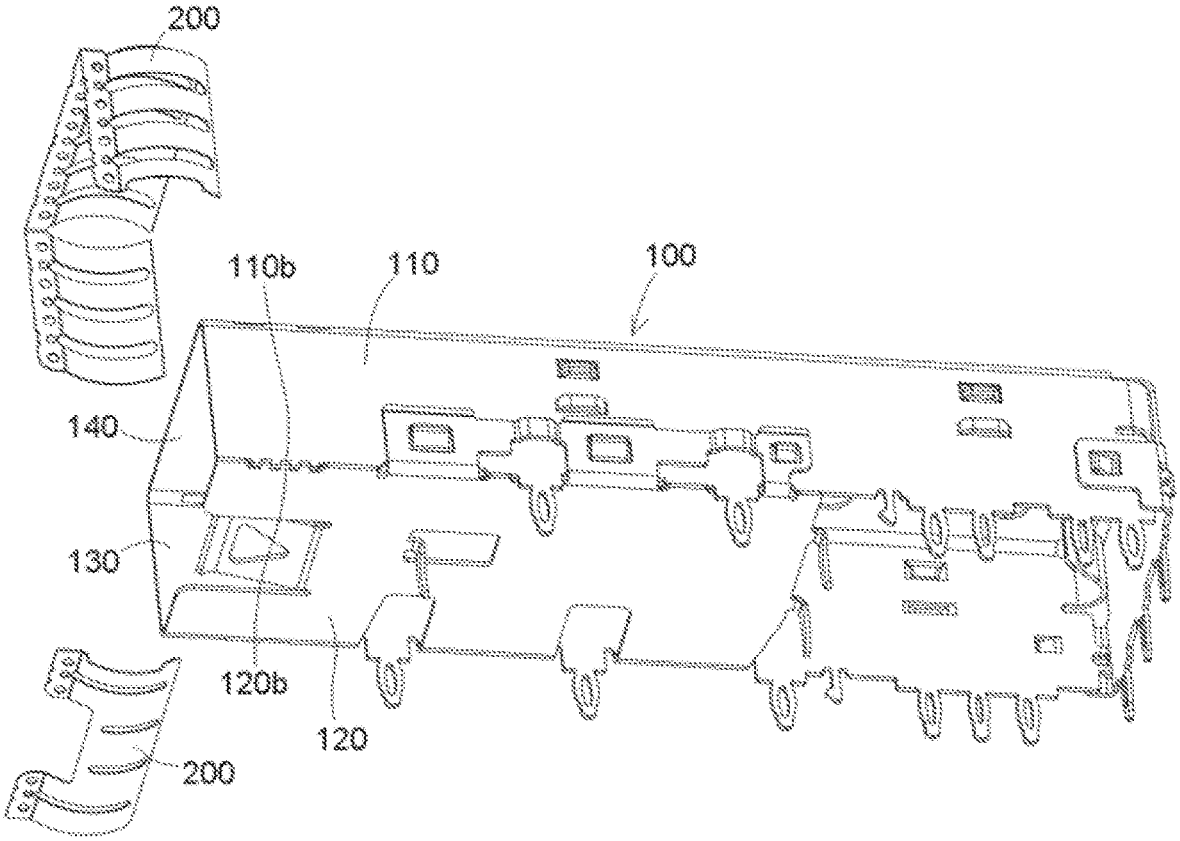
FIG. 2 is an exploded perspective view of the connector housing of FIG. 1.
Figure 3:
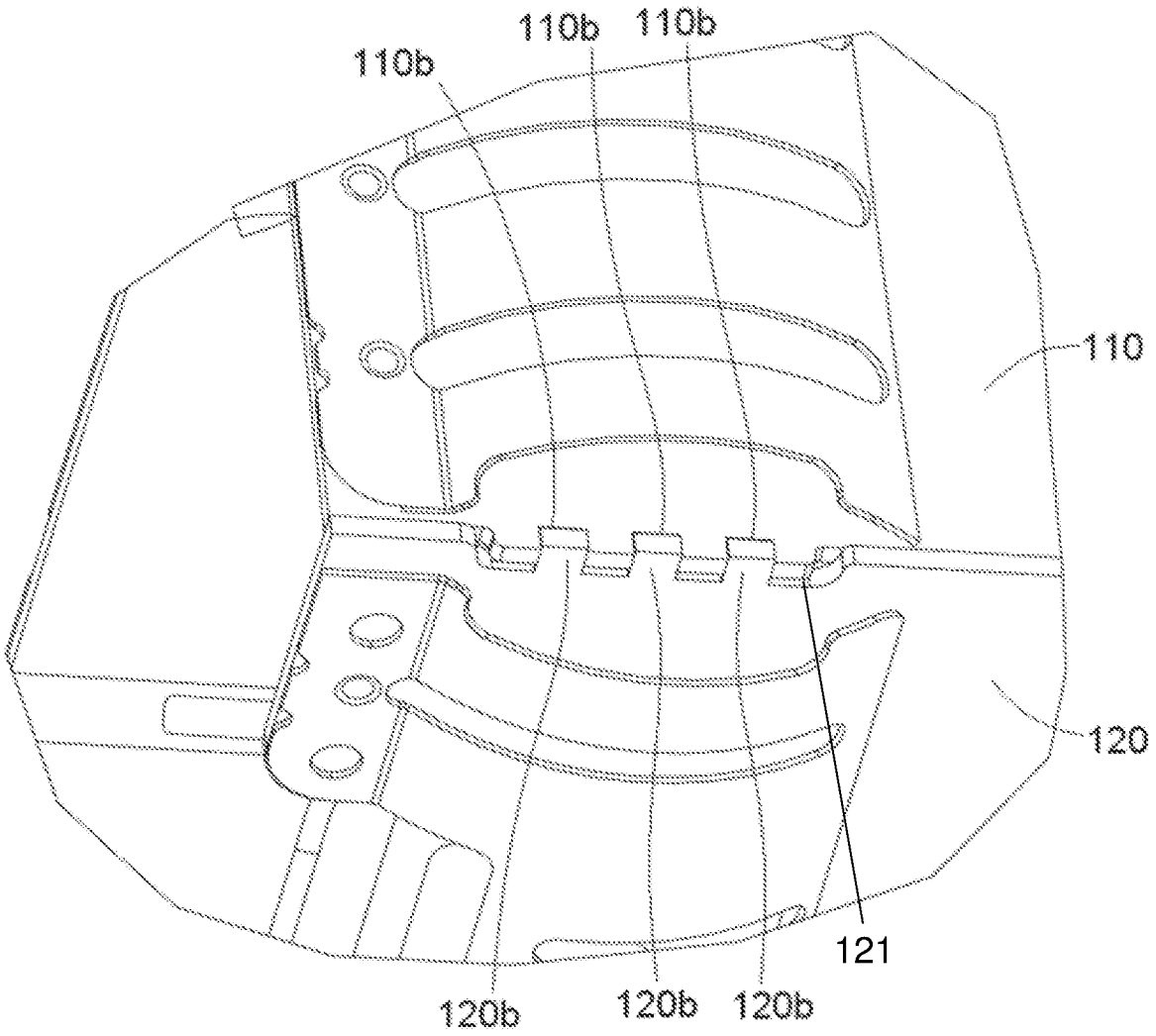
FIG. 3 is an enlarged perspective view of connecting mechanisms of the connector housing of FIG. 1.

A connector housing 100 according to an embodiment is shown in FIGS. 1-3.

As shown in FIGS. 1-3, the connector housing 100 includes a receiving space that is enclosed by four walls 110, 120, 130, 140 made of a conductive material and defining an insertion port. The connector housing 100, as shown in FIGS. 1 and 2, further includes elastic clips 200 for electromagnetic shielding. The elastic clips 200 are made of a conductive material and are mounted on the four walls 110, 120, 130, 140, respectively, near the insertion port. In the embodiment shown in FIG. 1, the elastic clips 200 may be riveted to the four walls 110, 120, 130, 140 of the connector housing 100 near the insertion port by a plurality of rivets 210.

Two adjacent walls 110, 120 of the four walls 110, 120, 130, 140 of the connector housing 100, as shown in FIGS. 2 and 3, have connecting mechanisms 110*b*, 120*b* at adjacent edges of the two adjacent walls 110, 120 near the insertion port. The connecting mechanisms 110*b*, 120*b* are complementary to each other and the adjacent edges are tightly connected to each other by the connecting mechanisms 110*b*, 120*b* to prevent the occurrence of a gap at a corner between the two adjacent walls 110, 120.

As shown in FIGS. 2 and 3, the connecting mechanisms 110*b*, 120*b* include at least one wedge-shaped slot 110*b* (also called a trapezoidal slot) formed on an edge of one wall 110 of the two adjacent walls 110, 120 and at least one wedge-shaped tooth (or trapezoidal tooth) 120*b* formed on an edge of the other wall 120 that is respectively engaged with the at least one wedge-shaped slot 110*b*. Adjacent ones of walls including a first wall defining a recess 121 formed in an edge thereof, and a second wall defining an adjacent edge at least partially engaging with the recess formed in the first wall. The adjacent edges of the two adjacent walls 110, 120 are tightly connected to each other by the wedge-shaped tooth 120*b* and the wedge-shaped slot 110*b*.

The wedge-shaped tooth 120*b*, as shown in FIGS. 2 and 3, is inserted straightly into the wedge-shaped slot 110*b* so that the adjacent edges of the two adjacent walls 110, 120 are tightly connected to each other. In an embodiment, after the wedge-shaped tooth 120*b* is inserted into the wedge-shaped slot 110*b*, the wedge-shaped tooth 120*b* may also be peened with a hammer so that the wedge-shaped tooth 120*b* is expanded around. In this way, the engagement between the wedge-shaped tooth 120*b* and the wedge-shaped slot 110*b* is improved and the close contact between the wedge-shaped tooth 120*b* and the wedge-shaped slot 110*b* is ensured, preventing the occurrence of a slight gap therebetween.

Figure 4:
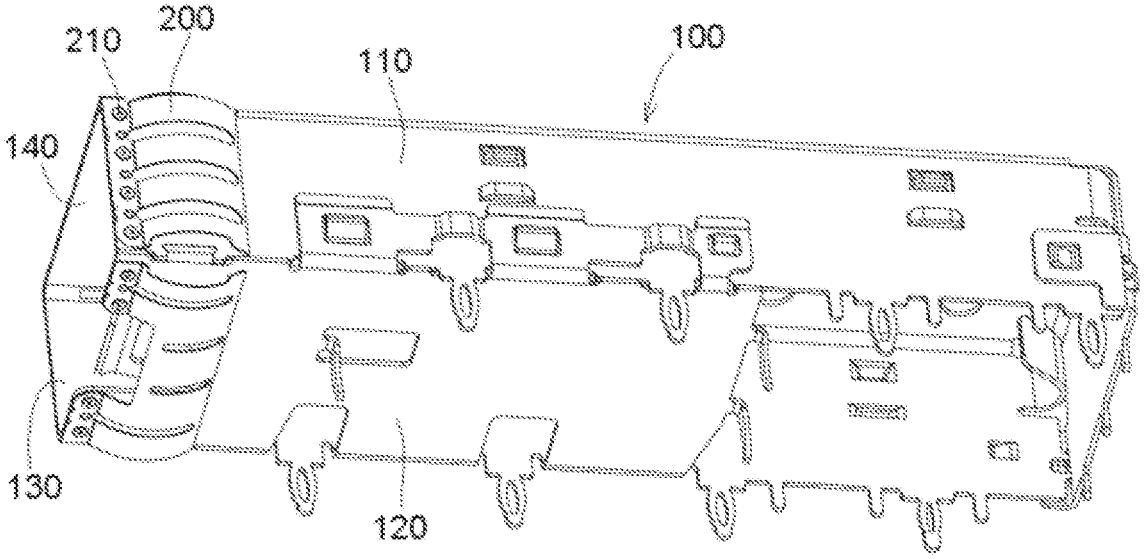
FIG. 4 is a perspective view of a connector housing according to an embodiment.
Figure 5:
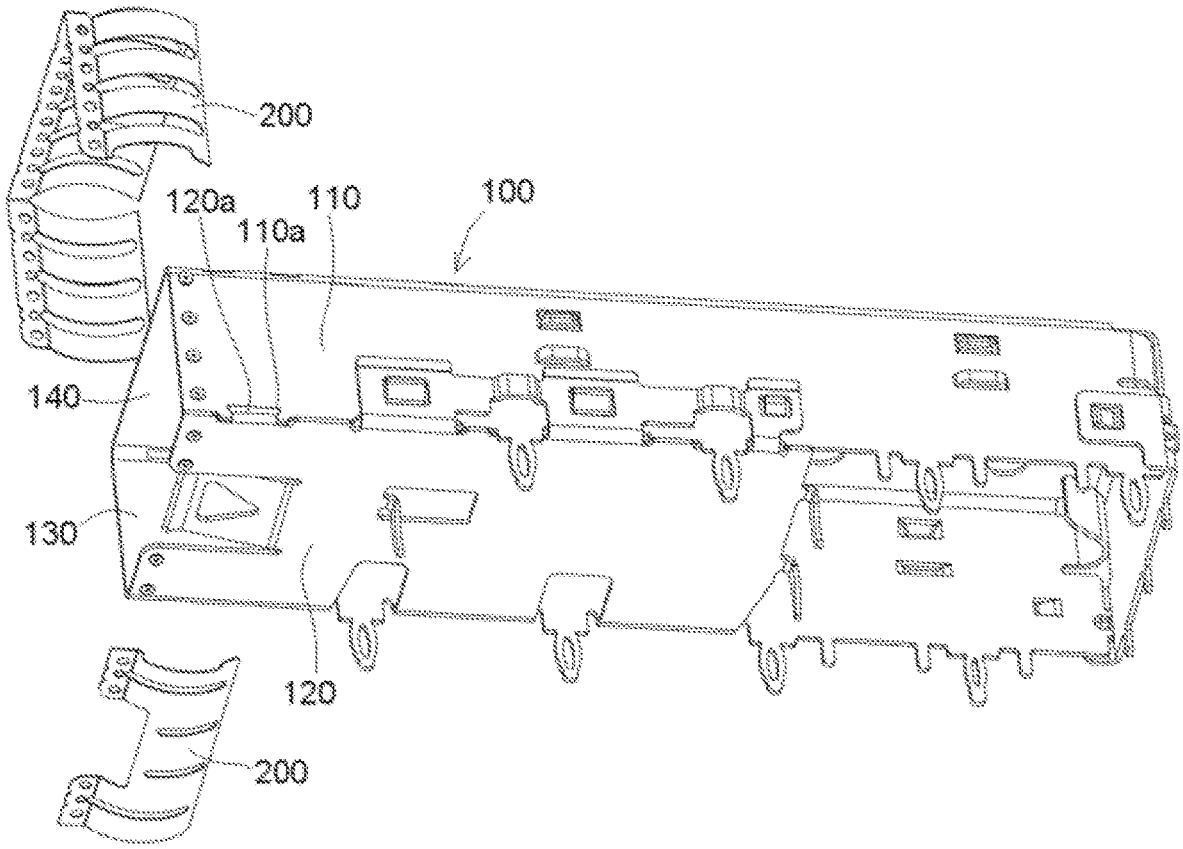
FIG. 5 is an exploded perspective view of the connector housing of FIG. 4.
Figure 6:
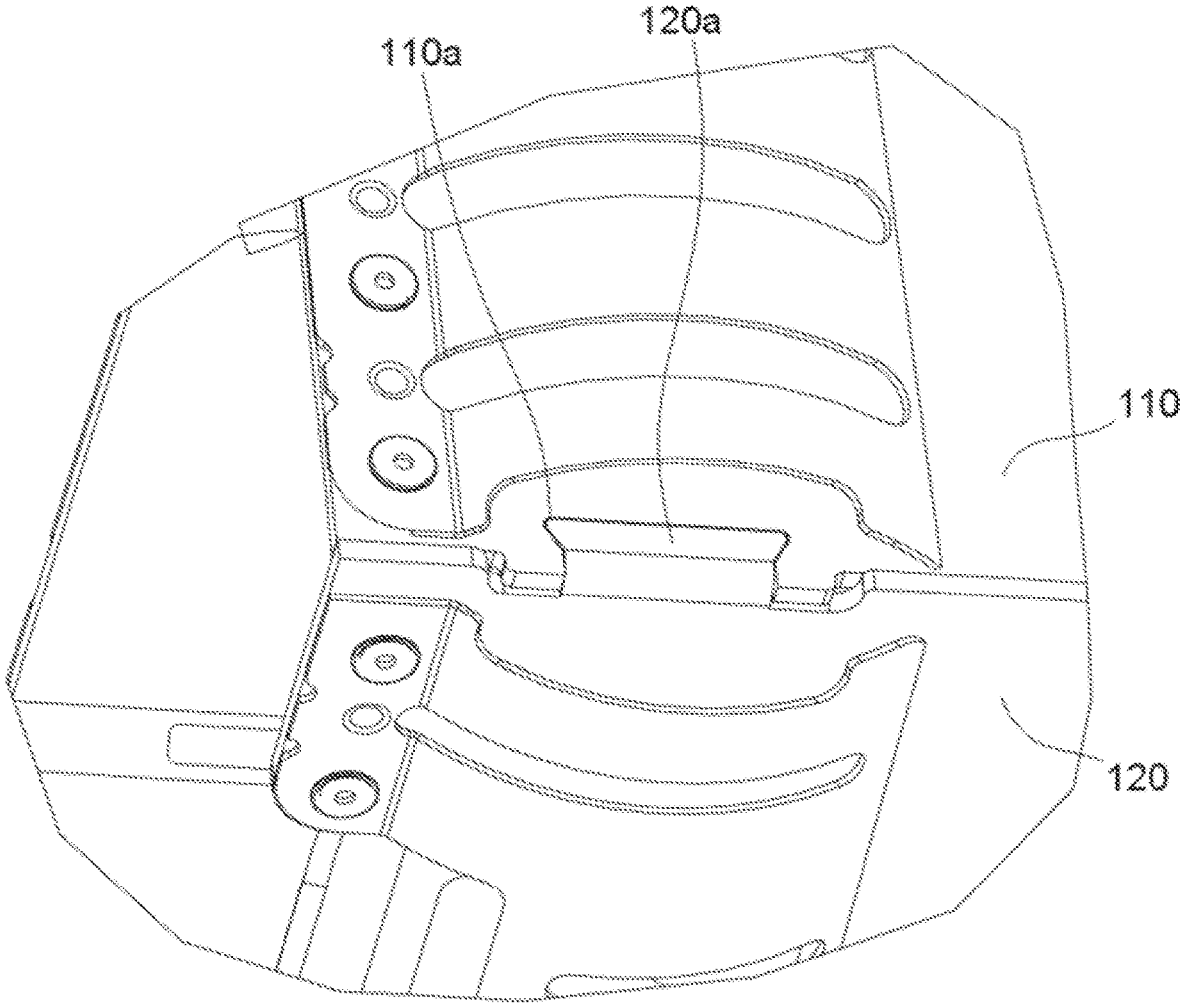
FIG. 6 is an enlarged perspective view of connecting mechanisms of the connector housing of FIG. 4.

A connector housing 100 according to another embodiment is shown in FIGS. 4-6. Like reference numbers indicate like elements with respect to the embodiment shown in FIGS. 1-3, and only the differences with respect to the embodiment shown in FIGS. 1-3 will be described in detail herein.

As shown in FIGS. 4-6, two adjacent walls 110, 120 of the four walls 110, 120, 130, 140 of the connector housing have connecting mechanisms 110*a*, 120*a* at adjacent edges of the two adjacent walls 110, 120 near the insertion port. The connecting mechanisms 110*a*, 120*a*, are complementary to each other and the adjacent edges are tightly connected to each other by the connecting mechanisms 110*b*, 120*b* to prevent the occurrence of a gap at a corner between the two adjacent walls 110, 120.

The connecting mechanisms 110*a*, 120*a*, as shown in FIGS. 5 and 6, include at least one dovetail groove 110*a* formed on an edge of one wall 110 of the two adjacent walls 110, 120 and at least one dovetail joint 120*a* formed on an edge of the other wall 120 that is respectively engaged with the at least one dovetail groove 110*a*. The adjacent edges of the two adjacent walls 110, 120 are tightly connected to each other by the dovetail joint 120*a* and the dovetail groove 110*a*.

As shown in FIGS. 5 and 6, the dovetail joint 120*a* is bent at an angle of about 90 degrees and inserted into the dovetail groove 110*a* so that the adjacent edges of the two adjacent walls 110, 120 are tightly connected to each other. In an embodiment, after the dovetail joint 120*a* is inserted into the dovetail groove 110*a*, the dovetail joint 120*a* may also be peened with a hammer so that the dovetail joint 120*a* is expanded around. In this way, the engagement between the dovetail joint 120*a* and the dovetail groove 110*a* is improved and the close contact between the dovetail joint 120*a* and the dovetail groove 110*a* is ensured, preventing the occurrence of a slight gap therebetween.

Connector housings 100 having two different connecting mechanisms for tightly connecting the two adjacent walls of the connector housing 100 have been described herein. In other embodiments, the connecting mechanisms may have other shapes and/or sizes as long as they tightly connect two adjacent walls of the connector housing 100.

What is claimed is:

1. A connector housing, comprising:

a plurality of walls enclosing a receiving space and defining an insertion port, each of a pair of adjacent walls of the plurality of walls including a first wall defining a recess formed in an edge thereof, and a second wall defining an adjacent edge at least partially engaging with the recess formed in the first wall, the first wall and the second wall are orthogonal and have one of a pair of connecting mechanisms at adjacent edges of the pair of adjacent walls near the insertion port, the pair of connecting mechanisms are complementary to each other and the adjacent edges of the pair of adjacent walls abut each other and are connected to each other without a gap by the connecting mechanisms, the pair of connecting mechanisms including:

a wedge-shaped tooth extending from the recess of the first wall of the pair of adjacent walls; and a wedge-shaped slot defined in the adjacent edge of the second wall of the pair of adjacent walls and arranged within the recess.

2. The connector housing of claim 1, wherein the wedge-shaped tooth extends from the recess in a direction of the first wall and engages the wedge-shaped slot within the recess to connect the adjacent edges of the first wall and the second wall.

3. The connector housing of claim 2, wherein the wedge-shaped tooth is inserted into the wedge-shaped slot to connect the adjacent edges of the first wall and the second wall.

4. The connector housing of claim 1, further comprising a plurality of elastic clips mounted on the plurality of walls near the insertion port.

5. The connector housing of claim 4, wherein each elastic clip is connected to one of the plurality of walls by a rivet.

6. A connector housing, comprising:

a plurality of walls enclosing a receiving space and defining an insertion port, each of a pair of adjacent walls of the plurality of walls including a first wall defining a recess formed in an edge thereof, and a second wall defining an adjacent edge at least partially engaging with the recess formed in the first wall, the first wall and the second wall are orthogonal and have one of a pair of connecting mechanisms at adjacent edges of the pair of adjacent walls near the insertion port, the pair of connecting mechanisms are complementary to each other and the adjacent edges of the pair of adjacent walls abut each other and are connected to each other without a gap by the connecting mechanisms, the pair of connecting mechanisms including:

a dovetail joint extending from the recess of the first wall of the pair of adjacent walls; and a dovetail groove formed in the adjacent edge of the second wall of the pair of adjacent walls and arranged at least partially within the recess.

7. The connector housing of claim 6, wherein the dovetail joint engages the dovetail groove to connect the adjacent edges of the first wall and the second wall.

8. The connector housing of claim 7, wherein the dovetail joint is bent at an angle of about 90 degrees and inserted into the dovetail groove to connect the adjacent edges of the first wall and the second wall.

* * * * *